United States Patent [19]

Borgman

[11] 4,347,721

[45] Sep. 7, 1982

[54] PLUG-TYPE LOCK WITH INCREASED STROKE

[75] Inventor: Randall W. Borgman, Holland Township, Ottawa County, Mich.

[73] Assignee: Haworth Mfg., Inc., Holland, Mich.

[21] Appl. No.: 165,470

[22] Filed: Jul. 2, 1980

[51] Int. Cl.[3] ..... E05B 17/04

[52] U.S. Cl. ..... 70/380

[58] Field of Search ..... 70/380, 379 R, 379 A, 70/85, 86, 87, 88, 77, 78, 81

[56] References Cited

U.S. PATENT DOCUMENTS

| | | | |
|---|---|---|---|
| 1,835,130 | 12/1931 | Wread | 70/380 |
| 1,876,803 | 9/1932 | Von Mehren | 70/380 |
| 2,275,362 | 3/1942 | Golden | 70/380 |
| 3,349,585 | 10/1967 | Walters | 70/86 |
| 3,436,939 | 4/1969 | Sewell | 70/379 R |

FOREIGN PATENT DOCUMENTS

| | | | |
|---|---|---|---|
| 262830 | 6/1968 | Austria | 70/380 |
| 1262143 | 2/1968 | Fed. Rep. of Germany | 70/380 |
| 1282872 | 7/1972 | United Kingdom | 70/380 |

*Primary Examiner*—Robert L. Wolfe

*Attorney, Agent, or Firm*—Blanchard, Flynn, Thiel, Boutell & Tanis

[57] ABSTRACT

A lock having a key-operated rotary plug supported within a shell. The rotary plug has an eccentric tenon which projects axially from the inner end thereof, which tenon is engaged within a transverse slot formed in the opposed face of the dead bolt to cause reciprocal slidable displacement thereof in a direction perpendicular to the rotational axis of the lock. The rotary plug also has a second eccentric tenon projecting axially from the inner end thereof, which second tenon is angularly spaced a substantial distance from the first-mentioned tenon. The bolt has a second slot which is closely adjacent but spaced from the first-mentioned slot. During rotation of the plug through a selected angle, such as 180°, one of the tenons engages one of the slots during only a portion of the selected angle to effect linear displacement of the dead bolt through a portion of its stroke. During this initial rotation, the other tenon is moved into the other slot such that, during the remainder of the rotation, the other tenon engages the other slot and causes continued linear displacement of the dead bolt.

4 Claims, 9 Drawing Figures

PLUG-TYPE LOCK WITH INCREASED STROKE

FIELD OF THE INVENTION

This invention relates to a key-operated rotary lock for use with a closure member, such as a drawer front or a cabinet door, and specifically an improved lock which provides increased linear stroke of the reciprocal lock bolt.

BACKGROUND OF THE INVENTION

Closure members associated with office furniture, such as drawer fronts and cabinet doors, are conventionally provided with key-operated rotary lock cylinders which actuate either a linearly or angularly movable dead bolt to permit locking of the closure member. Such lock cylinders are normally rotatably supported within a shell, the latter being fixedly positioned within a bore which extends through either the closure member or an adjacent stationary support. While such locks are notoriously well known and have been utilized with office equipment for many years, nevertheless such locks have been only marginally satisfactory in view of the inability to provide for the desired stroke or displacement of the linearly movable dead bolt, without increasing the overall size of both the shell and cylinder, which is obviously undesirable. Further, in some instances, the inability to provide a proper dead bolt stroke has required utilization of some other type lock, or the adaption of additional linkages or mechanisms. Such alternatives are normally expensive, result in more cumbersome structures, and hence are not of optimum design.

Thus, it is an object of this invention to provide a lock of the aforesaid type, which lock enables the reciprocal travel of the dead bolt to be significantly increased without changing the size or diameter of the rotary cylinder and its supporting shell, and without requiring additional secondary or complex mechanisms or linkages, whereby the improved lock of this invention thus overcomes the disadvantages associated with prior locks of this general type.

In the improved lock of this invention, the key-operated rotary plug or cylinder is supported within a shell which is fixed to either the closure member or the surrounding support frame. The rotary plug, as it is conventional, has an eccentric lug or tenon which projects axially from the inner end thereof, which lug engages within a transverse slot formed in the opposed face of the dead bolt to cause reciprocal slidable displacement thereof in a direction perpendicular to the rotational axis of the lock. This structure, as thus far described, is conventional with locks of this type. The linear displacement (i.e., stroke) of the dead bolt in this conventional lock is equal to the effective plug diameter, which effective diameter is equal to twice the radial distance from the plug rotational axis to the center of the tenon. According to the improvement of this invention, however, the rotary plug has a second eccentric lug or tenon projecting axially from the inner end thereof, which second lug is angularly spaced a substantial distance from the first-mentioned lug. The bolt, in the opposed face thereof, has a second slot which is closely adjacent but spaced from the first-mentioned slot. During rotation of the plug through a selected angle, such as 180°, one of the lugs engages one of the slots during only a portion of the selected angle to effect linear displacement of the dead bolt through a portion of its stroke. During this initial portion of the rotation, the other lug is being moved into the other slot such that, during the remainder of the rotation through said selected angle, the other lug engages said other slot and causes continued linear displacement of the dead bolt in the same linear direction. The linear displacement of the dead bolt occurs continuously in response to rotation of the plug, and is of a magnitude which exceeds the conventional effective diameter of the plug and of the lugs associated therewith.

In the improved lock of this invention, the shell and the rotary plug supported therein, which plug is key actuated and has suitable spring-urged lock wafers thereon, is provided with a single substantially cylindrical lug or tenon which is eccentrically positioned relative to the rotational axis of the plug and projects axially from the axially inner end thereof. This tenon has its periphery disposed substantially tangent to the cylindrical exterior surface of the plug. The shell has a pair of internal axially-extending slots which are diametrically opposite one another, and coact with the wafers to lock the plug in either of two positions which are angularly spaced 180° from one another, which positions define the locked and unlocked positions of the lock. A plate-like dead bolt is positioned directly adjacent the inner end of the plug and has a transverse slot in the front face thereof which has the tenon slidably engaged therein. This structure, as thus far described, is conventional and well known. According to the improvement of this invention, however, the plug is identical to that just described except that it is provided with a second lug or tenon which projects axially from the inner axial end of the plug, this second tenon being identical to the first-mentioned tenon and being both eccentrically displaced relative to the rotational axis, and positioned so that it is substantially tangent to the cylindrical peripheral surface of the plug. This second tenon is substantially angularly spaced from the first-mentioned tenon by an angle which substantially exceeds 90° but is substantially less than 180°. This second tenon is engageable with a second transverse slot formed in the front face of the bolt, which second slot is parallel to the first, and is positioned closely adjacent same but is spaced therefrom by an intermediate land or island. This land does not extend across the full face of the bolt so that the two slots communicate with one another adjacent one end thereof, whereby the tenons can move transversely back and forth between the two slots responsive to plug rotation. During rotation of the plug through its selected angle, such as 180°, the two tenons are sequentially moved into the respective slots to effect sequential engagement with and hence linear displacement of the dead bolt through a stroke which exceeds the conventional effective diameter of the plug.

In a preferred embodiment of the invention, the two tenons are disposed so that their cylindrical peripheries are not only tangent to the cylindrical periphery of the plug, but are also disposed so that their cylindrical peripheries are substantially tangent to a line which extends diametrically of the plug, with the two tenons being disposed on the same side of this diametrical line. This arrangement enables the dead bolt to have a linear stroke which is approximately equal to one and one-half times the conventional effective diameter of the plug, which stroke also approaches the maximum diameter of the circular path traveled by a point substantially tangent to the cylindrical peripheral surface of the plug during rotation of the plug.

The improved lock of the present invention, employing two tenons as explained above, is also desirable in that it enables the tenons to be positioned at more desirable angles relative to the slots in the dead bolt, such that the direction of movement of the tenon at its point of engagement with the respective slot is thus directed more significantly in the linear direction of travel of the dead bolt so as to facilitate the driving of the dead bolt, particularly at start-up when same is being displaced from one of its end positions. This improved lock, and specifically the use of the two tenons, thus enables the lock to avoid the positioning of the tenons at substantially dead-center positions when the dead bolt is at its end positions, such as is conventional with known single-tenon locks of this type, and hence this invention avoids the undesirable mechanical advantage or drive-force relationship which exists at such dead-center positions.

Other objects and purposes of the invention will be apparent to persons familiar with locks of this general type upon reading the following specification and inspecting the accompanying drawings.

Figures 1, 2, 3, 4, 5:
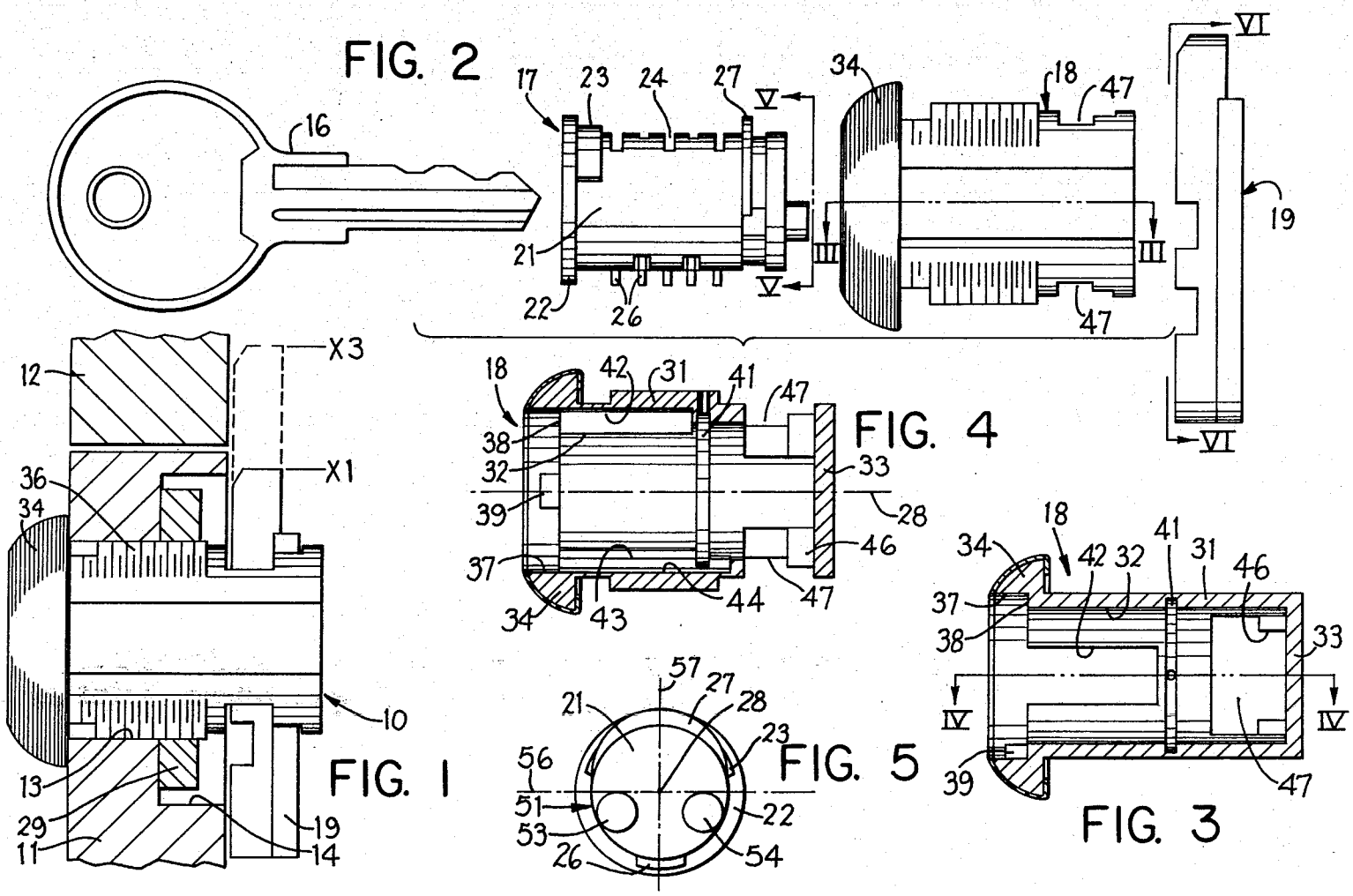
FIG. 1 is a side elevational view, partially in cross section, illustrating the mounting of the lock on a closure member.
FIG. 2 is an exploded view which illustrates the various components of the lock.
FIG. 3 is a sectional view of the shell as taken substantially along line III—III in FIG. 2.
FIG. 4 is a sectional view of the shell taken substantially along the line IV—IV in FIG. 3.
FIG. 5 is an elevational view of the inner end of the plug, as taken along line V—V in FIG. 2.
Figure 6:
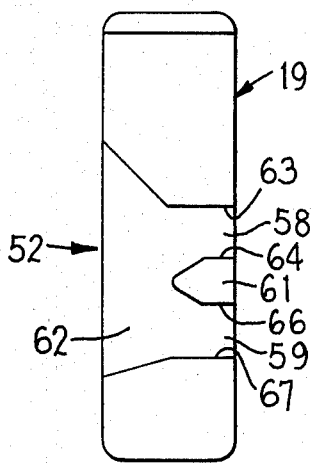
FIG. 6 is a front elevational view of the dead bolt, as taken along line VI—VI in FIG. 2.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the lock and designated parts thereof. Said terminology will include the words specifically mentioned, derivatives thereof and words of similar import.

DETAILED DESCRIPTION

Referring to the drawings, and specifically to FIG. 1, there is illustrated a lock assembly 10 which is designed for creating a locked relationship between a movable closure member 11 and an adjacent stationary structure 12. The lock is accommodated within a suitable opening or bore 13 which extends through the closure member 11, the inner end of which is provided with an enlarged surrounding recess 14 for a purpose to be explained hereinafter. While FIG. 1 illustrates the lock mounted on the movable closure member 11, it will be appreciated that the lock can also be mounted on the adjacent stationary structure 12 if desired, with its bolt being suitably movable for lockingly engaging the closure member, depending upon the desired operative relationship.

The lock assembly 10, as illustrated by FIG. 2, includes four primary components. The first comprises the key 16 which is substantially conventional and includes an axially grooved blade which, along one edge thereof, is suitably notched for cooperation with the spring-urged wafers or tumblers. The second component comprises the main plug or cylinder 17 which has a suitable key-receiving slot formed therein. The third component comprises the shell or sleeve 18 which rotatably supports the plug 17. The fourth component is the dead bolt 19 which is slidably mounted in the shell 18 for linear displacement in a direction perpendicular to the rotational axis of the plug 17, the dead bolt being suitably linearly reciprocated by rotational displacement of the plug 17.

Considering first the rotatable cylinder or plug 17, same comprises a cylindrical body 21 of substantially uniform diameter, which body terminates in an enlarged radially-outwardly projecting annular flange 22 at the outer or forward end thereof. A suitable arcuate stop 23 is fixed to the cylinder 21 and projects radially outwardly therefrom directly behind the front flange 22. A plurality of wafer-receiving grooves 24 are formed in the cylindrical body 21, which grooves 24 are disposed within plates which extend substantially perpendicular to the longitudinal axis 28, that is the rotational axis, of the plug. A plurality of said grooves 24 are formed in the plug, which grooves are disposed in axially adjacent but substantially parallel relationship. A suitable platelike wafer or tumbler 26 is slidably supported within each of the grooves 24, the individual wafers 26 being suitably spring-urged, as is conventional, into a lowermost position so as to project downwardly out of the respective grooves, as illustrated by FIG. 2. Insertion of the key 16 into the plug slot results in the notched blade of the key camming the wafers upwardly into the plug in a conventional and well-recognized manner. The plug 17 also has a platelike retainer 27 mounted thereon and projecting radially outwardly beyond the cylinder body 21.

The plug 17 is rotatably supported within the shell 18, which shell is formed as a sleeve 31 defining therein a cylindrical opening 32 in which the plug 17 is rotatably accommodated. The rearward or inner end of the sleeve 31 is suitably closed by an end wall 33. The outer or forward end of the sleeve is open so as to enable the plug to be slidably inserted into the shell. This outer end of the shell also has an enlarged annular flange 34 formed thereon, which flange defines a shoulder to permit the shell to be suitably seated within the bore 13 as illustrated by FIG. 1. The exterior of the sleeve 31, in the illustrated embodiment, is suitably threaded at 36 so as to receive thereon a lock nut 29, the latter being accommodated within the enlarged recess 14, whereby the shell 18 is fixedly secured to the closure member 11 due to the cooperation between the head flange 34 and the lock nut 29.

The front flange 34 of the shell 18 has an enlarged annular groove 37 which opens inwardly thereof, which groove terminates in a rear shoulder 38. The groove 37 rotatably accommodates the enlarged front flange 22 on the plug 17. A suitable stop 39 is fixed to the head flange 34 and projects radially inwardly of the annular groove 37. This stop 39 cooperates with the arcuate stop 23 formed on the plug 17 so as to limit the permissible angular rotation of the plug. The arcuate stop 23 is typically of substantial angular extent so as to cooperate with the stop 39 and thereby permit the plug 17 to be angularly disposed through a selected angle, normally 180°.

The sleeve 31, interiorly thereof, is provided with an annular groove 41 which is of greater diameter than the cylindrical bore or opening 32. This annular groove 41 accommodates therein the retainer plate 27 so as to axially fixedly secure the plug 17 within the sleeve. The interior of sleeve 31 also has a pair of diametrically opposite grooves 42 and 43 formed therein, which grooves communicate with the cylindrical bore 32 and project radially outwardly therefrom at diametrically opposite locations. These grooves 42 and 43 extend axially from the enlarged front groove 37 and project rearwardly to a location adjacent the annular groove 41. The groove 43 also has a narrow pick slot 44 which extends therealong to a location behind the retainer groove 41 so as to enable a long pick tool to be slidably displaced therealong when it is desired to dislodge the retainer plate 27 from the groove 41.

The inner end portion of the shell 18, which inner end portion projects beyond the closure member 11 as illustrated in FIG. 1, has a suitable guide slot 46 which extends perpendicularly through the shell directly adjacent the end wall 33 thereof. This guide slot 46, which slidably accommodates therein the dead bolt 19, defines openings 47 at opposite ends thereof for enabling the opposite ends of the dead bolt 19 to project outwardly of the shell.

The axially inner end of the plug body 21 is provided with lug or tenon means 51 fixedly associated therewith, which tenon means project axially beyond the plug and cooperate with suitable slot means 52 formed in and extending transversely across the front face of the bolt 19. This tenon means 51 includes a first tenon 53 which cooperates with the slot means formed in the dead bolt. The tenon 53 is a substantially cylindrical body or lug which projects axially outwardly from the inner end of the plug body and is eccentrically (that is, radially) displaced relative to the rotational axis 28 as to effectively function as an eccentric or crank. The tenon 53 is normally positioned such that its exterior cylindrical periphery is substantially tangent to the exterior cylindrical periphery of the plug body 21. The overall structure of the lock assembly, as described above, is substantially conventional. Reference is made specifically to locks of this general type as manufactured by Hudson Lock Company of Hudson, Massachusetts.

According to the improved lock assembly 10 of the present invention, the tenon means 51 includes a second tenon 54 which is substantially identical to the above-described tenon 53. This tenon 54 again comprises a substantially cylindrical eccentric which is disposed so that its peripheral surface is substantially tangent to the cylindrical periphery of the plug body 21. Further, this tenon 54 is suitably angularly spaced from the tenon 53 by an angle which normally substantially exceeds 90°, but which is substantially less than 180°. In a preferred embodiment, these two tenons 53 and 54 are normally disposed such that their cylindrical peripheries are tangent to a line 56 which extends diametrically across the plug body 21, with both of these tenons 53 and 54 being disposed on the same side of this diametral line 56.

To cooperate with the two tenons 53 and 54, the slot means 52 associated with the dead bolt includes upper and lower slots 58 and 59, respectively, which slots extend transversely across the dead bolt and are suitably spaced apart by an intermediate cam or abutment 61. This latter cam 61, as illustrated by FIGS. 6–9, does not extend across the full width of the dead bolt. Rather, the ends of these slots 58 and 59, adjacent one side of the dead bolt, communicate with one another by means of an enlarged opening 62 which extends vertically between the slots.

The upper slot 58 is suitably bounded by upper and lower abutment surfaces 63 and 64, respectively. The lower slot 59 is similarly bounded by upper and lower abutment surfaces 66 and 67, respectively. The abutment surfaces 63 and 66 suitably cooperate with the tenons 54 and 53, respectively, when the bolt is being moved into its one end position, namely the uppermost position shown by FIGS. 7–9, referred to as the locked position. On the other hand, the abutment surfaces 64 and 67 respectively cooperate with the tenons 54 and 53 when the dead bolt is being moved towards its other end position, namely the lowermost position illustrated in FIGS. 7–9, referred to as the unlocked position.

OPERATION

The operation of the improved lock assembly will be briefly described to ensure a complete understanding thereof.

Figure 7:
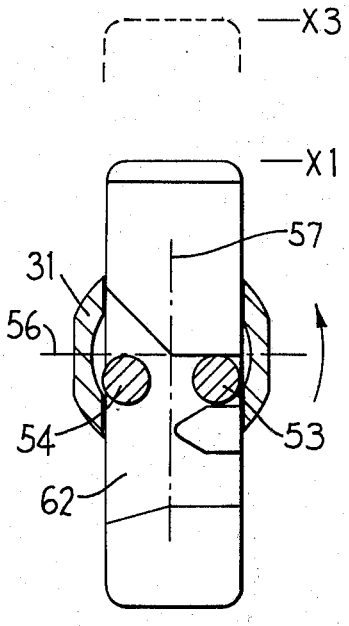
FIG. 7 is an elevational view illustrating the cooperative relationship between the tenons and the dead bolt, the latter being shown in one end position, such as its unlocked position.

In operation, and assuming that the dead bolt 19 is maintained in the unlocked position substantially as illustrated in FIGS. 1 and 7, then the end of the dead bolt is maintained substantially in the position designated X1. In this unlocked position, the tenons 53 and 54 are oriented as illustrated in FIG. 7, the tenon 53 being disposed within the upper groove 58, and the other tenon 54 being substantially horizontally aligned therewith. The lock wafers 26 are spring-urged downwardly as illustrated in FIG. 2, such that the lock wafers 26 are engaged within the slot 42 of the shell, thereby preventing rotation of the plug 21. The lock bolt 19 is thus held in this open position.

If it is desired to activate the lock so as to lock the closure 11, then the key 16 is inserted into the slot of the plug 21, which in turn causes the wafers 26 to be retracted upwardly into the slots, whereupon the plug 21 can then be rotated by the key through an angle of 180° (counterclockwise as indicated by the arrow in FIG. 7). The rotation is limited to 180° in view of the cooperation between the stops 23 and 39. When rotated 180°, the wafers 26 are now aligned with the diametrically opposite slot 43, whereupon withdrawal of the key results in the wafers being spring-urged outwardly so as to engage with the slot 43, thereby locking the cylinder 17 to the shell 18. During this rotation of the cylinder, the dead bolt 19 is linearly moved upwardly into the opposite end position, namely into the locked position, such that the upper end is positioned at the location designated X3. In this latter position, the dead bolt overlaps the inner face between the closure member 11 and the adjacent support 12, whereby the closure 11 is thus prevented from being movably displaced.

Figure 8:
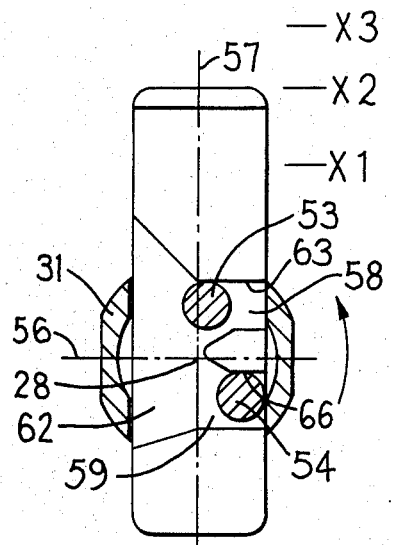
FIG. 8 is a view similar to FIG. 7 but illustrating the dead bolt in an intermediate position.
Figure 9:
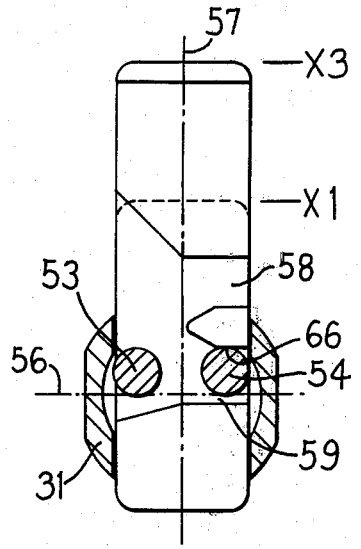
FIG. 9 is a view similar to FIG. 7 but illustrating the dead bolt in its fully extended or locked position.

During the rotation of the cylindrical plug 17, the dead bolt 19 is movably displaced substantially as illustrated by FIGS. 7–9. Initially, the tenon 53 is engaged within the upper slot 58. Thus, during the initial rotation of the plug, such as indicated by the arrow in FIG. 7, the tenon 53 bears against the abutment surface 63 and thus cams the dead bolt 19 upwardly, which upward camming by the tenon 53 continues until reaching the intermediate position X2 substantially as illustrated in FIG. 8. At this point, the other tenon 54 has swung downwardly through the opening 62 into the lower slot 58, and has now moved into engagement with the abutment surface 66. Thus, continued rotation of the plug 17 in the same direction as indicated by the arrow in FIG. 8, results in tenon 53 moving out of engagement with the abutment surface 63, so that tenon 54 now engages the abutment surface 66 and continues to movably displace the bolt 19 upwardly until it reaches its uppermost position X3, as indicated in FIG. 9, in which position the cylinder or plug 17 has been rotated through an angle of 180°.

When the key is to be released, then the key is again inserted into the plug and the latter is rotated 180° in the reverse direction to that indicated in FIGS. 8 and 7, whereupon the tenons then engage the opposite abutment surfaces 67 and 64 so that the bolt 19 is moved downwardly in just the opposite manner to that described above.

With the double-tenon and double-slot arrangement illustrated by FIGS. 7–9, the bolt 19 can be linearly slidably displaced through a working stroke which substantially exceeds the effective diameter of the conventional plug, which latter diameter also equals the maximum effective rotational diameter of the conventional tenon. More specifically, it has been determined that the bolt 19 can be easily provided with a linear working stroke which is approximately one and one-half times the aforesaid diameter.

In addition to the desirable increased stroke, as described above, this arrangement also provides for efficient force transfer between the tenons and the bolt. For example, during the initial movement of the bolt away from the lower end position illustrated in FIG. 1, the tenon 53 is being rotated at an angular relationship with respect to the surface 63 so as to result in a substantial transverse driving force being transferred from the tenon to the surface 63 at all times, even when the bolt is in its lowermost position. A similar desired relationship also exists between the tenon 54 and its engagement with the surface 66, as indicated in FIGS. 8 and 9. Further, when the bolt is being moved downwardly away from its uppermost position as indicated in FIG. 9, the engagement of tenon 54 with surface 67 also occurs with the tenon being moved in a direction which is substantially transverse to the surface 67, so that a substantial driving force is imposed against the bolt 19 to permit it to be easily moved downwardly out of its locked position. Due to this arrangement, the driving force transferred from the tenons to the bolt, when the latter is being moved away from its end positions, is substantial, so that only a minimal manual torque need be applied to the key so as to facilitate turning of the cylindrical plug.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a key operated lock device for a closure member, including a shell having a longitudinally extending bore; a cylinder plug supported in said bore for rotational movement relative to said shell about the axis of said plug, stop means for limiting rotation of said plug relative to said shell to a range of substantially 180° bounded by two limit positions which define locked and unlocked positions of said closure member, said plug having means defining a key-receiving slot in one end thereof and having a first generally cylindrical tenon fixed to and projecting axially outwardly from the other end thereof, the axis of said first tenon being spaced radially from said plug axis; a movable locking element coacting between said plug and said shell; and a slide bolt slidably supported on said shell adjacent said other end of said plug for movement in a first direction substantially perpendicular to said plug axis between two end positions which correspond to said locked and unlocked positions of said closure member, said slide bolt having means defining a first slot therein extending substantially transversely of said first direction, said first tenon being cooperable with said first slot during angular displacement of said plug between said limit positions to effect movement of said bolt; the improvement comprising a second generally cylindrical tenon fixed to and projecting axially outwardly from said other end of said plug, the axis of said second tenon being spaced radially from the axis of said plug and said first and second tenons each having a radius which is substantially less than the radius of said plug, the axes of said first and second tenons being angularly spaced from each other about said plug axis by an angle which exceeds 90° but is substantially less than 180°; and means defining a second slot in said slide bolt adjacent but spaced from said first slot and extending substantially transversely of said first direction, said first and second tenons respectively sequentially engaging said first and second slots during angular displacement of said plug and effecting linear displacement of said bolt through a stroke which substantially exceeds twice the radial distance between the axis of either said tenon and the axis of said plug.

2. A lock device according to claim 1, wherein said tenons each lie entirely within a cylindrical locus which is coaxial with said plug axis and has a radius equal to the radius of said plug, the cylindrical periphery of each said tenon being substantially tangential to said cylindrical locus.

3. A lock device according to claim 2, wherein said tenons each lie on the same side of, and are substantially tangential to, a line which extends diametrically across said plug.

4. A lock device according to claim 2 or claim 3, wherein said first and second slots each have a width which is slightly greater than the diameter of the associated tenon, said first and second slots being separated by an intermediate abutment having a width which approximately corresponds to the width of the transverse space between the tenons, said first and second slots adjacent one side of said bolt being in communication with one another through a connecting passage so that said tenons can move between said slots in response to angular displacement of said plug.

* * * * *